US006151996A

United States Patent [19]

Whiteford

[11] Patent Number: 6,151,996

[45] Date of Patent: Nov. 28, 2000

[54] ADJUSTABLE WRENCH

[76] Inventor: Carlton L. Whiteford, 3 High Point Rd., Westport, Conn. 06880

[21] Appl. No.: 09/338,108

[22] Filed: Jun. 23, 1999

Related U.S. Application Data

[60] Provisional application No. 60/091,265, Jun. 30, 1998.

[51] Int. Cl.[7] ..... B25B 13/12

[52] U.S. Cl. ..... 81/127

[58] Field of Search ..... 81/126, 127, 129, 81/129.5, 134, 98

[56] References Cited

U.S. PATENT DOCUMENTS

| | | | |
|---|---|---|---|
| 273,461 | 8/1883 | Calef . | |
| 758,266 | 4/1904 | Molin . | |
| 1,237,952 | 8/1917 | Pipshik . | |
| 1,354,552 | 10/1920 | Hart . | |
| 1,602,620 | 10/1926 | Larson et al. | 81/127 |
| 1,657,902 | 1/1928 | Ross | 81/126 |
| 2,351,821 | 6/1944 | Larson | 81/127 |
| 2,590,792 | 3/1952 | Reneer | 81/127 |
| 3,290,970 | 12/1966 | De Lucia | 81/127 |
| 4,802,389 | 2/1989 | Shultz | 81/127 |
| 5,016,503 | 5/1991 | Morton . | |

FOREIGN PATENT DOCUMENTS

| | | | |
|---|---|---|---|
| 11559 | of 1909 | France | 81/127 |
| 36081 | 4/1906 | Switzerland | 81/127 |

*Primary Examiner*—David A. Scherbel
*Assistant Examiner*—Joni B. Danganan
*Attorney, Agent, or Firm*—Spencer E. Olson

[57] ABSTRACT

An open-end wrench, which is self-adjusting and ratcheting, clamps at least four side surfaces of a nut or bolt head, and is adjustable to fit a range of sizes.

14 Claims, 2 Drawing Sheets

ADJUSTABLE WRENCH

This application claims the benefit of U.S. Provisional Application Ser. No. 60/091,265 filed Jun. 30, 1998.

BACKGROUND OF THE INVENTION

This invention relates generally to improvements in hat type of tools known as "sliding jaw" wrenches wherein a slidable jaw moves relative to a fixed jaw to clamp and release an inserted nut or bolt head. A wrench of this type described in U.S. Pat. No. 758,266 consists essentially of parallel faced fixed and movable jaws, the movable jaw having a rack-surface, in combination with an operating handle carried by a movable eccentric and provided with a toothed end adapted by the eccentric to be moved into and out of engagement with the rack surface of the movable jaw.

Another example of this type of wrench shown in U.S. Pat. No. 5,016,503 consists of first and second flat jaw members which lie one on top of the other with surfaces engaging in sliding relation for relative movement of the jaws toward and away from each other. A handle pivoted near one end on the first jaw member has on said one end teeth which engage corresponding teeth on the second jaw for moving the second jaw toward the first jaw to clamp a nut between the jaws. The pivot point of the handle is selected so that the force moving the second jaw toward the first jaw is always greater than the nut-turning force applied to the free end of the handle.

SUMMARY OF THE INVENTION

The wrench according to the invention is self-adjusting and ratcheting and consists, essentially, of the combination of a flat fixed jaw member and a movable jaw member supported in sliding relation on guide surfaces within the fixed jaw member for relative movement of the jaws toward and away from each other. The confronting faces of the opposing jaws of the wrench each have two nut-gripping faces angularly oriented relative to each other to define, when the jaw spacing is maximum, a nut-receiving opening having sides, each adapted to grip a a respective side of a six-point nut or bolt head of money different size. On nuts or bolt heads of smaller size (within the size range of the wrench) at least four of the sides will be firmly gripped. The movable jaw has a toothed rack-surface, and an operating handle pivoted near the head end to the fixed jaw member has teeth on the head end which mesh with teeth on the rack-surface of the movable jaw.

The fixed jaw, while fixed with respect to the movable jaw, is rotatable about its pivotal connection to the handle by movement of a thumb-operated actuator which is slidable along a portion of the head end of the handle and coupled to the fixed jaw by a connecting link. The actuator is normally spring-biased away from the head end of the handle to a position at which the jaws define a minimum opening by a tension spring anchored at one end within the handle and connected at the other end to the actuator. The jaws are opened from this minimum spacing, to the size of the nut or bolt head to be engaged, by pushing the actuator toward the pivot, which causes the fixed jaw to rotate about the pivot, and the handle teeth to engage the teeth on the rack-surface of the movable jaw and move it away from the fixed jaw to the desired spacing. Because the spring biases the movable jaw toward the minimum jaw opening, when the actuator is released the jaws automatically adjust to the nut size and will be held in engagement with the nut.

The jaw spacing is adjustable over a range of nut sizes; in a 9-inch wrench, for example, for use with nuts for 7/16-inch to ¾-inch bolts, which heretofore required two sets of open end wrenches to cover that range.

BRIEF DESCRIPTION OF THE DRAWINGS

Other objects, features and advantages of the invention will become apparent, and its construction and operation better understood, from the following detailed description, taken in conjunction with the accompanying drawings, in which.

DETAILED DESCRIPTION OF THE PREFERRED EMBODIMENT

Figure 1:
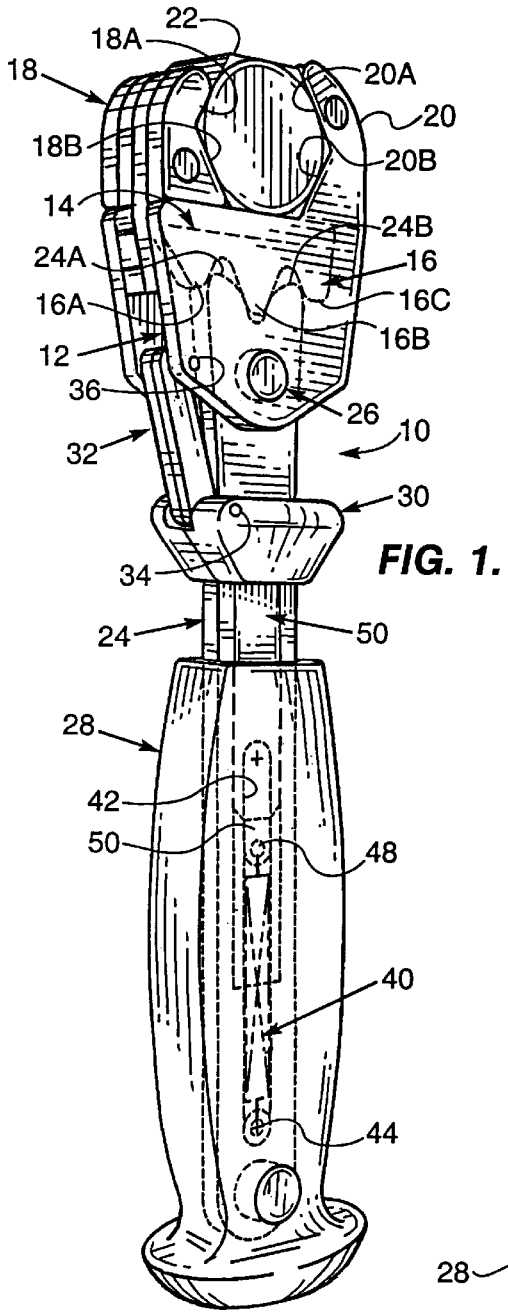
FIG. 1 is a respective view of the wrench, shown in a restrained position as it would be packaged for display.
Figure 6A:
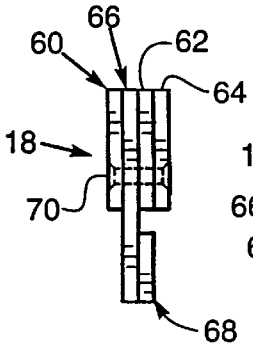
FIGS. 6 and 6A are plan and edge views, respectively, of the movable jaw member of the wrench.
Figure 6:
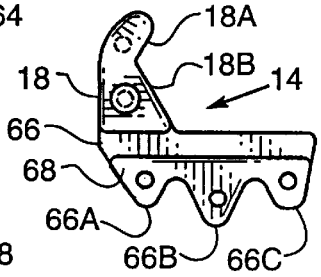
Figure 7:
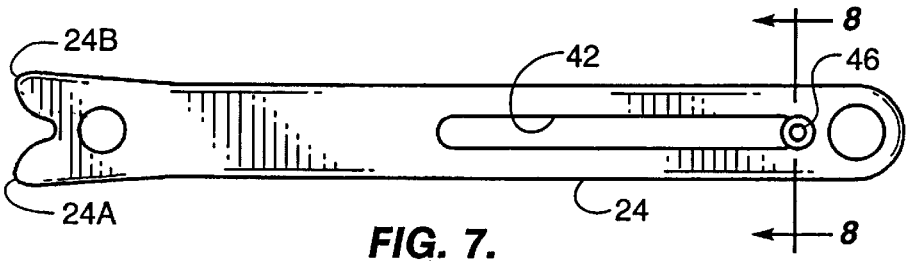
FIG. 7 is a plan view of the wrench handle.
Figure 8:
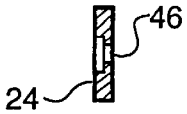
FIG. 8 is a sectional view taken along line 8—8 of FIG. 7.

As seen in FIG. 1, the wrench 10, shown restrained for packaging and display with a retainer 22 having the shape of a bolt head, includes a flat fixed jaw member 12 and a movable jaw member 14 supported on guide surfaces within the fixed jaw member (to be described) for relative movement of the jaws toward and away from one another. Referring also to FIGS. 6 and 6A, movable jaw member 14 has a downwardly directed rack-surface 16 having three rounded teeth 16A, 16B and 16C separated by two similarly-shaped valleys, and an integral upstanding jaw 18. The face of jaw 18 has a curved upper end and two faces 18A and 18B angularly fixed at 120°; also, jaw face 18B and the horizontal define a 120° angle.

Fixed jaw member 12 is generally U-shaped in plan, has a larger area than the movable jaw member, and has an integral upstanding jaw 20 having an inwardly curved upper end and two faces 20A and 20B also angled at 120°, and with face 20B oriented at an angle of 120° to the horizontal. With the faces of the jaws thus angularly oriented, the four jaw faces together with the horizontal surface defined by the upper edge of the fixed jaw member, define a five-sided opening, each side adapted to engage a standard size side of a nut or bolt head of that standard size.

The wrench is manipulated with a flat elongate operating handle 24, preferably formed of hardened steel, pivoted near its head end to fixed jaw member 12 with a relatively large pivot pin 26. The head of the handle has a pair of separated teeth 24A and 24B contoured to operatively mesh with the teeth forming the rack-surface of movable jaw 14. A major portion of the length of handle 24, as measured from its free end, is encased in a plastic gripping handle 28 for user comfort and also to protect and conceal additional elements of the wrench mechanism; the balance of the length, i.e., from the inner end of gripping handle 28 to the fixed jaw member 12, is uncovered.

The size of the opening between the jaws 18 and 20 of the jaw members is adjusted by rotating the fixed jaw member 12 about its pivot pin 26 connection to the handle by moving a thumb-operated actuator 30, which is slidable along a selected portion of the handle which extends from the upper end of handle grip 28 to the lower edge of fixed jaw member 12. The actuator 30, which may be a molded plastic part generally oval in cross-section, has an axial opening shaped to receive handle 24, and is mechanically coupled to fixed jaw member 12 with a flat connecting link 32 which extends from a point 34 at one side and near the top of actuator 30, to a point 36 on the fixed jaw member 12, which point is laterally off-set from pivot pin 26. The link is pivotally connected at points 34 and 36 with respective pins which allow jaw member 12 to rotate about pivot pin 26 in response to up and down movement of actuator 30 along the handle.

Actuator 30 is normally drawn away from fixed jaw member 12 by a tension spring 40 disposed within an elongate slot 42 in handle 24 and anchored at one end on a transverse pin 44 which extends through a hole 46 located near the distal end of handle 24; the other end of the spring is secured in a hole 48 formed in the end of a metal strip 50. Strip 50 comprises two flat metal strips, in slidable contact with respective opposing top and bottom surfaces of handle 24, the upper ends of which are molded into or otherwise secured to actuator member 30.

Figure 3:
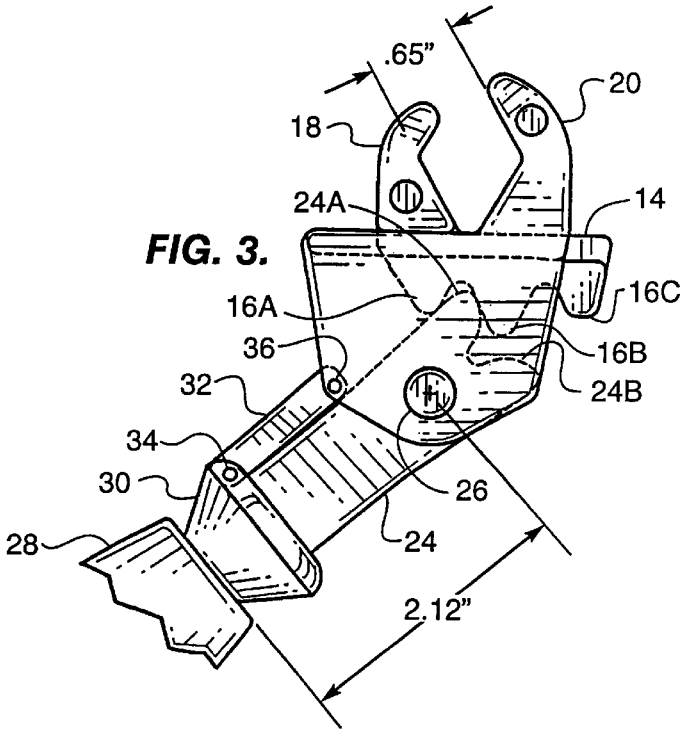

Thus, absent the retainer 22 or a nut or bolt head restraining the wrench as shown in FIG. 1, tension spring 40 will pull actuator 30 away from fixed jaw member 12 until it is blocked by the upper end of the molded grip 28, as seen in FIG. 3. As a result of this movement of actuator 30, connecting link 32 rotates fixed jaw member 12 counterclockwise about pivot pin 26, forces the inner edge of link 32 into contact with the adjacent edge of handle 24, and causes the mating teeth on the handle 24 and on the movable jaw member 14 to move the latter toward fixed jaw member 12. In short, the tension spring 40 biases the jaws toward the minimum-opening position of the jaws shown in FIG. 3. By way of example, a 9-inch wrench has a minimum jaw opening of 0.675 inch, which occurs when the spacing between pivot pin 26 and the lower edge of actuator 30 is 2.12 inches.

Figure 2:
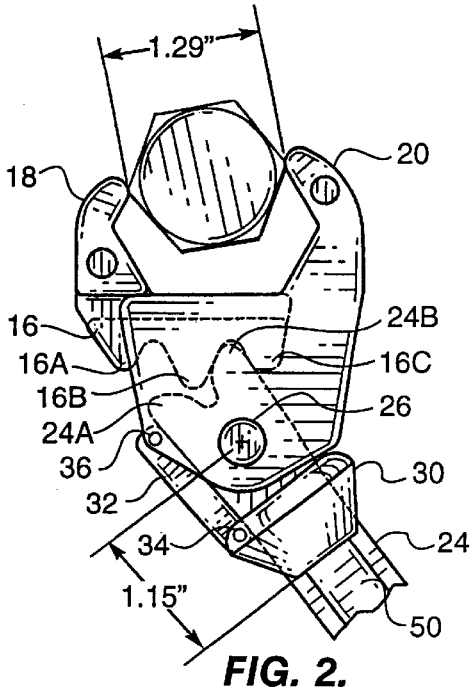
FIGS. 2 and 3 are fragmentary plan views of the wrench respectively showing its maximum and minimum jaw openings.

The jaws may be opened from the minimum spacing shown in FIG. 3 to accommodate any sized nut or bolt head up to the maximum opening of 1.29 inches depicted in FIG. 2, as follows. While grasping handle grip 28 in one hand, the user pushes actuator 30 upward with the thumb of that hand, against the tension of spring 40, to a position on handle 24 at which the spacing between pivot pin 26 and the lower edge of actuator 30 is 1.15 inches. This upward movement of actuator 30, together with the action of link 32, rotates fixed jaw member 12 clockwise about pivot pin 26, causing the teeth 24A and 24B on the handle mating with the teeth 16A, 16B and 16C on the movable jaw member to slide to the left relative to the fixed jaw member.

After the jaws have been placed around a nut of any size in the range between the minimum and maximum openings, thumb pressure on actuator 30 is released, allowing tension spring 40 to pull actuator 30 away from the jaws, causing fixed jaw member 12 to rotate about pivot pin 26 and move the jaws toward one another into gripping engagement with the side surfaces of the selected size nut. FIG. 1 shows the handle 24 positioned for tightening, with the jaws engaging a six-point nut having the shape of retainer 22; clockwise rotation of the handle about pivot pin 26 causes nut clamping movement of movable jaw member 14 toward fixed jaw member 12, the clamping force being the turning force applied to the handle multiplied by the leverage or mechanical advantage from the pivotal movement of the handle, a first class lever. Counterclockwise rotation of the handle about pivot pin 26 from the nut clamping position releases the clamping force and spreads the jaws apart sufficiently to permit ratcheting of the wrench to a new nut gripping position. To loosen a previously tightened nut, the wrench is flipped over from the position shown in FIG. 1; counterclockwise rotation of the reversed handle about pivot pin 26 causes nut clamping movement of the movable jaw member toward the fixed jaw member.

Figure 4A:
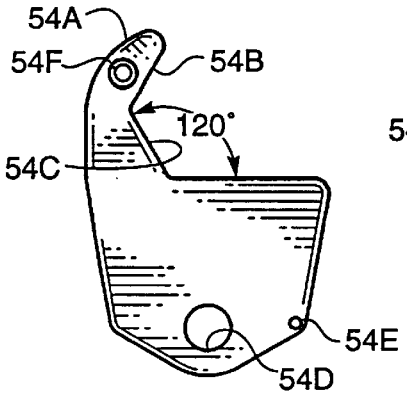
FIGS. 4, 4A and 4B are edge, left plan and right plan views, respectively, of a component of the fixed jaw member of the wrench.
Figure 4:
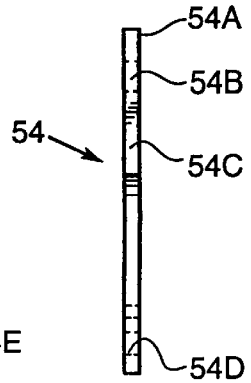
Figure 4B:
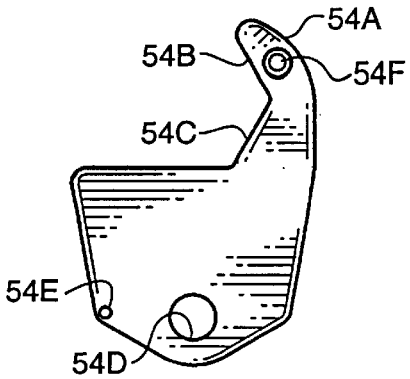
Figure 5A:
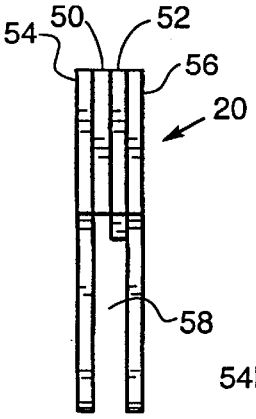
FIGS. 5 and 5A are plan and edge views, respectively, of the fixed jaw member.
Figure 5:
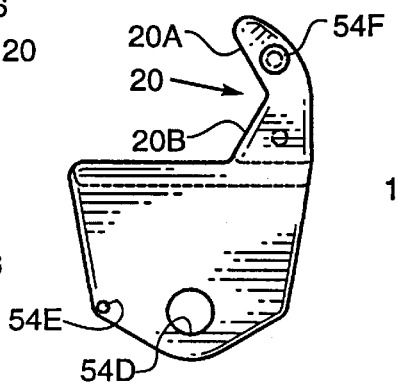

Referring to FIGS. 4 and 5, fixed jaw member 12 is a laminated structure comprising four steel laminae: two inner laminae 50 and 52 secured by spot-welding between identical oppositely disposed outer steel laminae 54 and 56, edge, left-side and right-side views of one of which are shown in FIGS. 4, 4A and 4B, respectively. The lamina 54, generally U-shaped in plan, may be stamped from ⅛-inch thick steel and then hardened and tempered. The stamping has an integral upstanding jaw 54A having adjacent inwardly-directed faces 54B and 54C angularly oriented at 120°, and has three holes therethrough: a large hole 54D for receiving pivot pin 26, a small hole 54E for receiving a connecting link pin and a countersunk hole 54F for receiving a rivet for further securing the laminae together.

Reverting to FIG. 5A, the inner laminae 50 and 52 are both shorter than the outer laminae, lamina 50 is shorter than lamina 52, and together they define an internal guide-way 58 for receiving and precisely guiding the movable jaw member.

Referring to FIGS. 6 and 6A, movable jaw member 14 also has a laminated construction comprising five steel laminae which together have the same total thickness as that of the fixed jaw member: three laminae 60, 62 and 64 having the shape of the upstanding jaw (FIG. 6), a fourth lamina 66 of the same shape but longer than the other three, sandwiched between laminae 60 and 62, and a fifth lamina 68 secured to the lower edge surface of lamina 66, which together with the lower edge of lamina 66, define the rack-surface shown in FIG. 6, having three rounded teeth 66A, 66B and 66C. Lamina 68 is spot-welded at three points to lamina 66, and laminae 60, 62, 64 and 66 are spot-welded together and further secured by a rivet 70.

The described laminated construction provides equal-thickness jaw members having directly confronting flat jaw surfaces so the nut gripping forces on the jaws are balanced.

While a 9-inch wrench has been described by way of example, it will be understood that it may be manufactured in other lengths, say 7-inch and 11-inch, with a corresponding scaling of sizes of the jaw members and handle. Also, while the described wrench jaws consist of laminated metal stampings, they may be constructed using other methods without departing from he spirit of the invention. For example, the jaw members could be forged and guideways then machined in the fixed jaw forging for receiving and supporting the movable jaw member in sliding relation for relative movement of the jaws. As another alternative, the jaw members may be formed by a known investment casting process; by this process the movable jaw member could be a one-piece casting, with the fixed jaw member comprising two castings. While the forging and investment processes both may be more expensive than the laminated construction, there may be other factors that would favor their use.

While the best mode for carrying out the invention has been described in detail, it will now be evident to those familiar with the art to which this invention relates that various changes may be made in the invention without departing from its spirit and scope. Therefore, the invention is not limited to that which is shown in the drawings and described in the specification, but only as indicated in the appended claims.

What is claimed is:

1. A self-adjusting open-end ratchet wrench for use with a range of sizes of nuts or bolt heads comprising, in combination:

a first jaw member slidably supported in a second jaw member, said jaw members having opposed jaws configured to define a nut-receiving opening of adjustable size having at least four gripping sides;

a handle pivoted between its ends to said second jaw member and at one end engaging a rack on said first jaw member for moving said jaws between a first position at which said jaws define a maximum-sized nut-receiving opening and a second position at which said jaws define a minimum-sized nut-receiving opening; and spring-biased means biasing said jaws toward said second position with a force sufficient to hold the opposed jaws in gripping engagement with a nut or bolt head received in the nut-receiving opening, wherein said spring-biased means includes an actuator member slidably supported on said handle and pivotally connected to said second law member.

2. A wrench as defined in claim 1, wherein said spring-biased means includes a tension spring biasing the jaws toward said second position, and wherein said jaws are user-movable away from said second position by application to the actuator member of force sufficient to overcome the tension of said spring.

3. A wrench as defined in claim 1, wherein said spring-biased means comprises an actuator member slidably supported on said handle for relative movement along a selected portion of the handle length, means linking said actuator member to said second jaw member at a point laterally offset from the point at which said handle is pivoted, and a tension spring having one end connected to said actuator member and a second end anchored to said handle.

4. A wrench as defined in claim 3, wherein said handle, except for said selected portion, is encased in a handle grip which protects and conceals said tension spring.

5. A wrench as defined in claim 3, wherein the means linking said actuator member to said second jaw member is a link member connected between a pivot point on the actuator member and a pivot point on said second jaw member.

6. A wrench as defined in claim 1, wherein said second jaw member is supported in sliding relationship on guide members disposed within said first jaw member for relative movement of said jaw members toward and away from one another.

7. A wrench as defined in claim 1, wherein said opposed jaws each have two nut-gripping surfaces oriented at an angle of 120° relative to each other.

8. A wrench as defined in claim 1, wherein said one end of said handle has contoured teeth mating with contoured teeth on said rack on the first jaw member, the other end of the handle being adapted to apply a nut-turning force.

9. A wrench as defined in claim 1, wherein said first and second jaw members are generally flat laminate structures each comprising multiple laminae, the laminae forming said second jaw member being shaped and arranged to define internal guide surfaces for supporting the first jaw member i n sliding relationship.

10. A self-adjusting open-end ratchet wrench for use with a range of sizes of nuts or bolt heads comprising, in combination:

a generally flat fixed jaw member and a generally flat movable jaw member supported in sliding relationship on guideways disposed within said fixed jaw member for relative movement of said jaw members toward and away from one another, said jaw members having opposed jaws each having angularly-oriented nut-gripping faces together defining a nut-receiving opening of adjustable size having at least four nut-gripping sides;

a generally flat handle member pivoted between its ends to said fixed jaw member, one end of said handle being adapted to receive a nut-turning force and the other end of said handle having contoured teeth mating with a rack of correspondingly contoured teeth on said movable jaw member for moving said jaw members toward and away from one another between a first position at which said jaws define a maximum-sized nut-receiving opening and a second position at which said laws define a minimum-sized nut-receiving opening; and spring-biased means comprising an actuator member slidably supported on said handle for relative movement along a selected portion of the length of said handle, a link member coupling said actuator member to a pivot on said fixed jaw member which is laterally offset from the point at which said handle is pivoted, and a tension spring having a first end connected to said actuator member and a second end anchored to said handle biasing the jaws toward said second position with sufficient force to hold the opposed jaws in gripping engagement with a nut received in the nut-receiving opening, said actuator member being movable against the tension of said spring and operative to move said jaw members toward said first position.

11. A wrench as defined in claim 10, wherein said opposed jaws each have two nut-gripping surfaces oriented at an angle of 120° relative to each other.

12. A wrench as defined in claim 11, wherein said fixed and movable jaw members are laminates each consisting of multiple laminae, the laminae forming said fixed jaw member being shaped and arranged to form internal guideways for supporting the movable jaw in sliding relationship.

13. A wrench as defined in claim 10, wherein a major portion of the length of said handle member, except for said selected portion, is encased in a handle grip for user comfort and for protecting and concealing said tension spring.

14. A self-adjusting open-end ratchet wrench for use with a range of sizes of nuts or bolt heads comprising, in combination:

a first jaw member slidably supported on guideways within a second jaw member, said jaw members having opposed jaws shaped to define a nut-receiving opening of adjustable size having at least four nut-gripping sides;

a handle pivoted between its ends to said second jaw member and at one end engaging a rack on said first jaw member for moving said jaws between a first position at which said jaws define a maximum-sized nut-receiving opening and a second position at which said jaws define a minimum-sized nut-receiving opening; and spring-biased means biasing said jaws toward said second position with a force sufficient to hold the opposed jaws in gripping engagement with a nut or bolt head received in said nut-receiving opening, wherein said spring-biased means includes an actuator member slidably supported on said handle and pivotally connected to said second jaw member.

* * * * *